United States Patent [19]

Perry, Jr. et al.

[11] 4,129,963

[45] Dec. 19, 1978

[54] TOY ARTICLE HAVING CHANGEABLE EXPRESSION GRAPHICS

[75] Inventors: Francis V. Perry, Jr., Foxboro, Mass.; Richard P. Barlik, Cumberland, R.I.; William P. Richardson, South Easton, Mass.; Robert H. Hudson, Seekonk, Mass.; Leonard Gray, South Attleboro, Mass.

[73] Assignee: Hasbro Development Corp., Pawtucket, R.I.

[21] Appl. No.: 830,350

[22] Filed: Sep. 2, 1977

[51] Int. Cl.[2] ..... A63H 1/22

[52] U.S. Cl. ..... 46/155

[58] Field of Search ..... 46/49, 64, 65, 155

[56] References Cited

U.S. PATENT DOCUMENTS

| | | | |
|---|---|---|---|
| 907,092 | 12/1908 | Schoenhut | 46/155 |
| 3,805,444 | 4/1974 | Adickes | 46/155 |

*Primary Examiner*—Russell R. Kinsey
*Assistant Examiner*—Robert F. Cutting
*Attorney, Agent, or Firm*—Salter & Michaelson

[57] ABSTRACT

A toy article having a body formed in an egg-like configuration and including a top portion and a base in which a weight is located, the weight insuring that the body will always return to an upright position regardless of exterior forces applied thereto. A central section is disposed between the base and the top portion and is rotatable relative thereto, the central section being divided symmetrically into an opaque portion and a clear portion. Located interiorly of the central section is a fixed interior band having graphic material imprinted thereon that is visible when the clear portion of the central section is aligned therewith, wherein relative movement of the central section with respect to the interior band, locates a selected part of said graphic material in alignment with the clear portion of the central section for visual access thereto.

10 Claims, 6 Drawing Figures

TOY ARTICLE HAVING CHANGEABLE EXPRESSION GRAPHICS

BACKGROUND OF THE INVENTION

The present invention relates to toy articles and particularly to a toy doll that has graphic material imprinted thereon for simulating or representating various human characteristics or other figures.

The toy article as embodied in the present invention is similar in construction to the toy article illustrated and described in U.S. Pat. No. 3,805,444. The toy article as disclosed in U.S. Pat. No. 3,805,444 has an egg-like configuration, a weight being located in the bottom portion thereof so as to insure that the toy will always return to an upright position regardless of exterior forces applied thereto.

Fanciful designs or figures are imprinted on the exterior surfaces of the base, central and top portions of the article as disclosed in U.S. Pat. No. 3,805,444 so that by varying the size of the article, considerable play value may be attached thereto when a number of the toy articles are used in a group. Although the toy article as described in the aforesaid patent accomplished the purpose intended and does have considerable play value, the graphic material imprinted thereon was nonchangeable in the appearance thereof and in order to provide a different character, a separate toy article had to be utilized.

SUMMARY OF THE INVENTION

The toy article embodied in the present invention is of the type as illustrated in U.S. Pat. No. 3,805,444, and includes a weighted base to which a top portion is secured by means of a downwardly extending shank. A central tubular section is positioned between the base and top portion and is rotatable relative thereto, a portion of the central section being opaque and another portion thereof being clear for visual access therethrough. An interior band is located within the central section and is fixed relative thereto and is provided with graphic material thereon that simulate human facial characteristics, or are representative of other fanciful figures. Upon rotation of the central section relative to the base and top portion and the interior band, the clear portion of the central section is aligned with a selected area of the band to display a graphic design therethrough. The remaining graphic material as imprinted on the interior band is hidden from view behind the opaque portion of the central section.

Accordingly, it is an object of the present invention to provide a toy article formed in an egg-like configuration and weighted at the bottom so as always to be returnable to an upright position, the body including a base to which a top portion is secured, and a central section that is located between the base and top portion and is rotatable relative thereto, a band being fixed interiorly of the central section and having graphic material located thereon, the central section being moveable relative to the base and top portion to selectively locate a part of the graphic material in a position for visual access thereto.

Other objects, features, and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
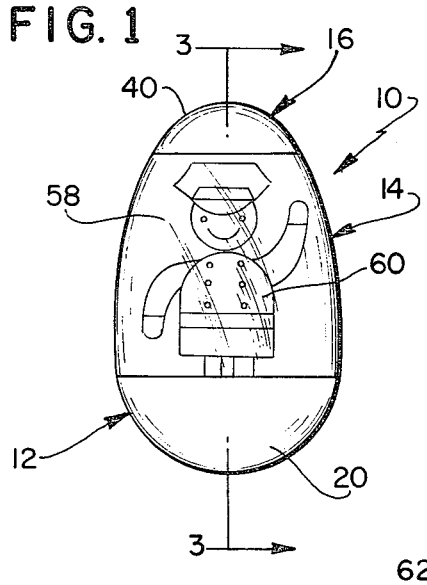
FIG. 1 is an elevational view of the toy article embodied in the present invention.
Figure 2:
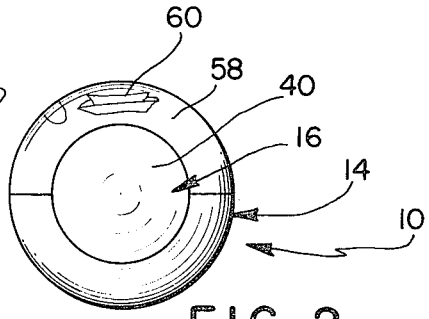
FIG. 2 is a top plan view thereof.

Referring now to the drawing and particularly to FIGS. 1 through 4, a first embodiment of the toy article of the present invention is illustrated and is generally indicated at 10. The toy article 10 as shown is defined by a body formed in an egg-like configuration, the egg-like body including a weighted base generally indicated at 12, a tubular central section generally indicated at 14, and a top portion generally indicated at 16 that is located on the tubular central section 14 and that is interconnected to the base 12 to unite the portions together. An interior band 18 is located interiorly of the central section 14, and as will be described, has a plurality of character-like figures or graphics imprinted thereon. Since the body is always retained in an upright position, because of the weighted base 12, the imprinted figures on the egg-like body will impart certain characteristics thereto and thereby increase the play value of the toy article.

Figure 4:
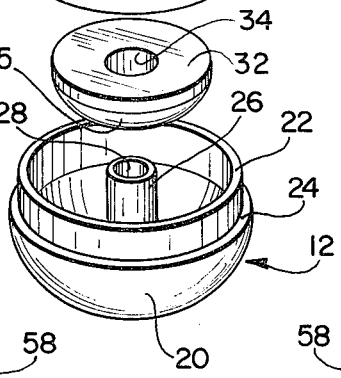
FIG. 4 is an exploded perspective view of the toy article illustrated in FIG. 3.
Figure 4:
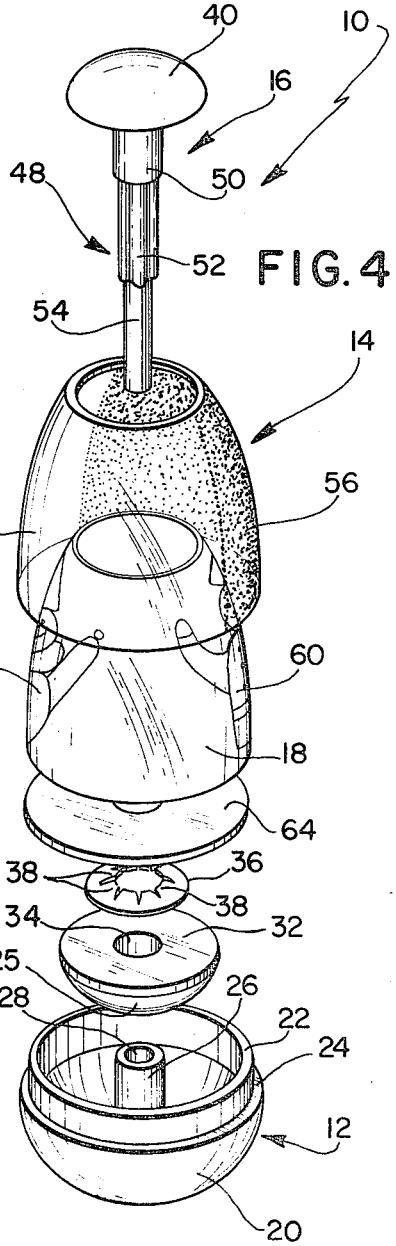
Figure 3:
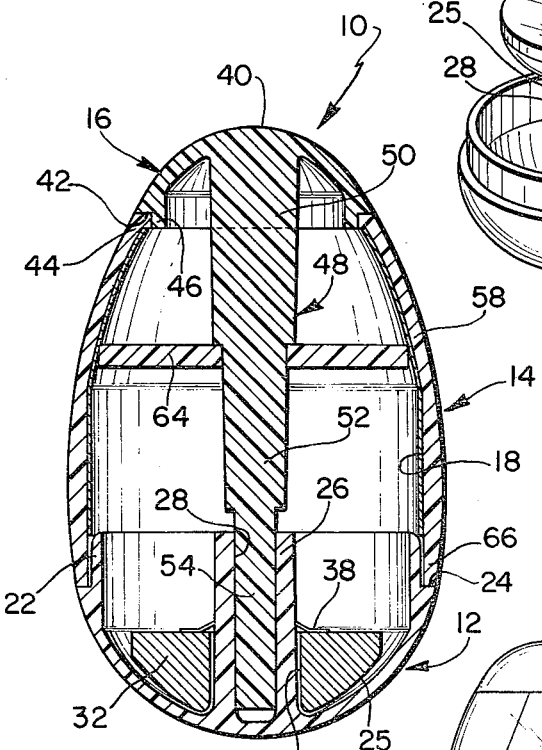
FIG. 3 is a sectional view taken along line 3—3 in FIG. 1 illustrating one form of the toy article as it is embodied herein.
Figure 6:
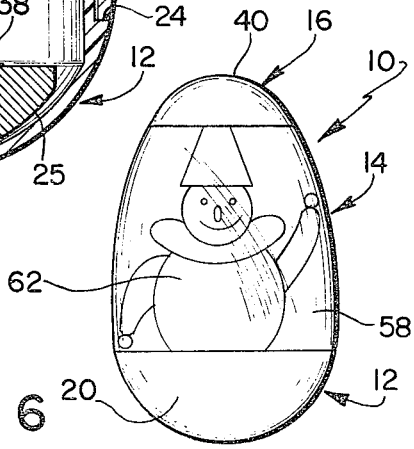
FIG. 6 is an elevational view of the toy article showing a selected graphic illustration behind a clear portion of the central section, the graphic material being different from that illustrated in FIG. 1.

Referring specifically to FIGS. 3 and 4, the preferred form of the toy article 10 is illustrated in detail therein, and as shown, the base 12 includes a curved bottom wall portion 20 to which an upper annular reduced flange 22 is joined that defines a shoulder 24 therewith. Formed interiorly of the bottom wall portion 20 is a cavity 25 and projecting upwardly from the interior surface of the bottom wall portion 20 and located within the cavity 25 is a central column 26 having a bore 28 formed therein. Received in the interior cavity 25 as formed in the bottom wall portion 20 is a weight 32, the bottom surface of which is curved to conform to the configuration of the bottom wall portion 20. The weight 32 has a central opening 34 formed therein through which the column 26 extends for mounting the weight 32 in the cavity 25 of the base 12, a pressure type washer 36 is provided and is fitted over the column 26. As illustrated in FIG. 3, the washer 36 is formed with fingers 38 that enable the washer to be inserted over the column 26 but that lock the washer 36 in place on the column 26 in engagement with the weight 32 and effectively retain the weight 32 in the base portion 12.

As mentioned hereinabove, the top portion 16 is secured to the base 12 for assembling the parts together, and as shown includes a rounded top wall 40, the radius of curvature of which is substantially less than that of the bottom wall 20. The curvature of the top wall 40 and the dimension thereof is also designed to provide a continuous surface thereof with the adjacent surfaces of the central section 14 when the parts are located in interfitting relation. The central section, which is tubular in configuration, has a relatively wide bottom portion, but tapers upwardly to a relatively small opening for receiving the top wall 40 of the top portion 16. In order to accomodate the upper portion of the central section 14, an annular notch is formed in the rounded top wall 40 of the top portion 16 to define an annular shoulder 42 that engages an upper lip 44 of the central section 14, the notch also defining an annular neck section 46 that is dimensioned for being received within the upper lip 44 of the central section 14. Joined to the top wall 40 of the top portion 16 and projecting downwardly therefrom is a shank generally indicated at 48, the shank 48 being defined by an upper portion 50, a reduced central portion 52, and a further reduced lower portion 54. The lower portion 54 is received in the bore 28 of the column 26 of the base 12 and may be permanently secured therein by the application of an adhesive in the bore 28 prior to the insertion of the lower portion 54 of the shank 48 therein. It is seen that when the top portion 16 is secured to the base 12, the central section 14 is mounted therebetween, and as will be described hereinafter, the central section 14 is rotatably moveable relative to both the top portion 16 and the base 12.

Referring now to FIG. 4, the central section 14 as shown, is formed of a clear plastic material, approximately one-half of which is painted a dark opaque color or that is molded in a manner to produce a semi-annular opaque portion indicated at 56. The remaining semi-annular portion of the central section 56 is clear so as to be visible therethrough, the clear portion being indicated at 58. Located interiorly of the center section 14 is the inner band 18 that has a configuration generally corresponding to that of the center section 14, the band 18 being preferably formed of a plastic film and having graphic material such as character representations indicated at 60 and 62 imprinted thereon. In the assembly of the toy article 10, the band 18 is located in contact with the inner surface of the center section 14 as shown in FIG. 3 but is fixed relative thereto, as will be described.

One of the novel features of the invention as embodied in the toy article 10 is is the selective location of a graphic illustration depicted at 60 and 62 on the inner band within the visible or clear portion 58 of the central section 14. This is accomplished by rotating the central section 14 relative to the base 12, top portion 16 and the inner band 18 that is restrained against movement. Thus, the rotation of the central section 14 will selectively align the clear portion 58 with either of the character representations or graphics 60 or 62 as desired. This increases the play value of the toy article and has interesting applications in the use thereof. In order to restrain the band 18 against movement upon rotation of the central section 14, a friction element 64 is provided and is mounted on the shank 48 of the top portion 10. As shown more clearly in FIG. 3, the friction element is formed with an opening 66 that is dimensioned to receive the center portion 52 of the shank 48. The friction washer 64 is butted against the shoulder as defined by the junction between the top portion 50 and the center portion 52 of the shank 48 and is held in position thereagainst. In this connection, the friction element 64 may be locked to the center portion 52 of the shank 48 by friction or by adhesive, as necessary. Referring again to FIG. 3, the inner band 18 is shown bearing against the upper peripheral edge of the friction washer 64 and is held in place thereby upon the rotating movement of the center section 14. It is also understood that the center section 14 is interfitted over the flange 22 of the base 12 in sliding relation, and for this purpose a lower portion 66 of the center section 14 is received over the flange 22, and abutts against the shoulder 24 as formed on the base 12.

In the construction of the toy article 10 as illustrated in FIGS. 1–4, the various components are assembled in the manner as illustrated in FIG. 3, the inner band 18 being located interiorly of the center section 14 and engaging the friction element 64 in frictional relation. The shank 48 of the top portion 16 is secured within the column 26 of the base 12 and unites the components of the toy article in a unitary construction. In use of the article, either of the graphics 60 or 62 is located behind the clear visible portion 58 of the center section 14. It is understood that any form of graphic material such as character representations or representations of human features can be depicted on the inner band 18 and will be visible through the clear portion 58 of the center section when moved into alignment therewith. Since the opaque portion 56 of the center section restricts visual access to the remaining area of the inner band 18, only the graphite materal located behind the clear portion 58 will be visible. When it is desired to change the appearance of the article, the center section 14 is rotated relative to the top portion 16 and the base portion 12, thereby moving the clear portion 58 into alignment with the other graphic representation on the inner band 18. The opaque portion 56 then obscures or hides the area of the band 18 not visually accessible through the clear portion 58.

Figure 5:
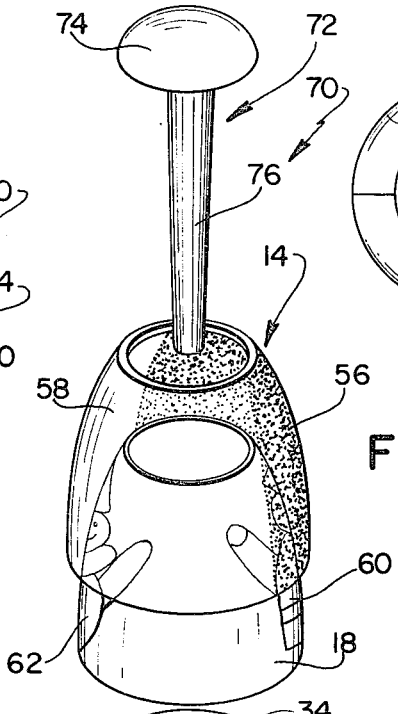
FIG. 5 is an exploded perspective view of a modified form of the toy article.

Referring now to FIG. 5, a modified form of the invention is illustrated and is generally indicated at 70. The toy article 70 includes a base generally indicated at 12 that is identical to the base previously described in connection with FIGS. 1–4, the base 12 including a rounded bottom wall 20, a flange 22 that defines a shoulder 24 and an upstanding column 26 having a bore 28 formed therein. A weight 32 formed with a rounded bottom wall and an opening 34 is positioned within the cavity formed in the base 12, the opening 34 receiving the central column 26 therein as previously described. A center section 14 having a tubular configuration and shape identical to that described above is mounted on the base 12, as shown in FIG. 5, and includes an opaque portion 56 and a clear portion 58. An inner band 18 is located interiorly of the center section 14; however in the form of the invention as shown in FIG. 5, the lowermost edge of the inner band 18 envelopes the flange 22 of the base 12 and is secured thereto so as to enable the center section 14 to be rotatable relative thereto. The lowermost edge of the center section 18 overlaps the band 18 and is also received on the shoulder 24 of the base 12 in interfitting but sliding relation with respect thereto.

In order to secure the elements in position as shown in FIG. 5, a top portion generally indicated at 72 is provided and includes a top wall 74 of rounded configuration having a radius of curvature that is substantially less than that of the bottom wall 20. The diameter of the top wall 74 is also of a dimension that is received on the edge that defines the upper opening of the center section 14, the top wall 74 of the top portion 72 being constructed similarly to that illustrated in FIG. 3, so that the top wall interfits with the adjacent upper edge of the center section. Contrary to the formation of the shank 48 as utilized as illustrated in FIGS. 1–4, the top portion 72 includes an elongated tapered shank 76 that extends into the bore 28 of the column 26 of the base 12. Suitable adhesive can be injected into the bore 28 for securing the lowermost end of the tapered shank 76 in the bore 28.

As previously described, the inner band 18 is held against movement by the securement of the lowermost edge thereof around the flange 22 of the base 20. Thus, the center section 14 is moveable relative to the inner band 18 to selectively locate a graphic illustration depicted on the band 18 behind the clear portion 58 of the center section. As previously described, the inner band 18 may have various graphics imprinted thereon that will impart human characteristics or other interesting graphic representations to the article, such as a face, clothing, hands, and other human features. The base and top portion may also be molded in a color or design that will cooperate with the color of the graphic material to create various designs that have interesting play value.

Although not illustrated in the drawing, it is also contemplated that the center section can be formed in two separate sections, the first section being a clear plastic material of a configuration similar to the center section 14, and the second section also being formed of a plastic material, but with one-half of the wall surface thereof being clear and the other half being opaque. The second section is assembled within the first section and secured thereto by a suitable adhesive applied to the edges thereof. The use of the toy article as so modified is identical to that described above.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy article comprising a base having a rounded bottom wall in which a cavity is defined and including an upwardly extending flange that defines the uppermost portion of said base, a central tubular section having a portion thereof that has an upwardly reducing diameter, the lowermost portion of said central section engaging a flange of said base, a portion of said central section being opaque and a portion thereof being clear to provide for visual access therethrough, an interior band located within said central section and having graphic material imprinted thereon that is visible when the clear portion of said central section is aligned therewith, a top portion having a shaft that extends downwardly through the interior of said central section for engagement with said base for assembling the base, central section and top portion as a unit, said central section being moveable relative to said base and top portion to selectively locate a part of said graphic material in alignment with the clear portion of said central section for visual access thereto.

2. A toy article as claimed in claim 1, a weight located in said cavity and lowering the center of gravity of the assembled unit to such an extent that the rounded bottom wall cooperates with the weight to retain the body in an upright position regardless of exterior forces applied thereto.

3. A toy article as claimed in claim 2, the uppermost end of said tubular central section having an opening formed therein that has a diameter that is less than the diameter of an opening formed in the lowermost end thereof, said top portion including a rounded head to which said shaft is joined, said head being received in the opening in the uppermost end of the central section closing the top of said central section.

4. A toy article as claimed in claim 3, said head being interfitted with the uppermost end of said central portion such that said central section is moveable relative thereto.

5. A toy article as claimed in claim 2, a washer mounted on said shaft intermediate said head portion and weight and frictionally engaging the interior surfaces of said interior band to locate said interior band in a substantially fixed position, wherein said central section is rotatable relative to said interior band to selectively locate a part of said graphic material in alignment with the clear portion of said central section.

6. A toy article as claimed in claim 2, a central column located in said base and extending upwardly from the bottom wall thereof, said column having a bore formed therein in which said shaft is received in secured relation, and a lock member interfitted over said column and engaging said weight for locking said weight in said base.

7. A toy article as claimed in claim 1, said base having a flange formed on the uppermost end thereof that defines a shoulder with the adjacent portion of said base, said band being interfitted over said flange for engagement with said shoulder in fixed relation to said base, said central section enveloping said band and overlaping said flange so as to be mounted on said base for rotation relative thereto, to said band and said top portion.

8. A toy article as claimed in claim 7, a weight located in said cavity and lowering the center of gravity of the assembled unit to such an extent that the rounded bottom wall cooperates with the weight to retain the body in an upright position regardless of exterior forces applied thereto, an upstanding column joined to said bottom wall and extending through said weight, said top portion having a downwardly extending tapered shank that is secured in said column to join the base to said top portion.

9. A toy article having a rounded bottom wall in which a cavity is defined, a central tubular section mounted on said base for rotating movement relative thereto, a portion of said central section being opaque and a portion thereof being clear to provide for visual access therethrough, an interior band located within said central section and having graphic material imprinted thereon that is visible when the clear portion of said central section is aligned therewith, a top portion engaging said central section but being fixed relative thereto, wherein said central section is moveable relative to said base and top portions to selectively locate a part of said graphic material in alignment with the clear portion of said central section for visual access thereto.

10. A toy article as claimed in claim 9, means located interiorly of said central section for fixing said interior band against movement upon rotation of said central section.

* * * * *